US006441287B1

(12) United States Patent
Crouch et al.

(10) Patent No.: US 6,441,287 B1
(45) Date of Patent: Aug. 27, 2002

(54) SNARE DRUM MECHANISM

(75) Inventors: Steve P. Crouch, Greenville, IL (US); Mark W. Schafer, Lake Geneva, WI (US); Roy A. Murray, Woodstock, IL (US)

(73) Assignee: Advanced Percussions, Greenville, IL (US)

( * ) Notice: Subject to any disclaimer, the term of this patent is extended or adjusted under 35 U.S.C. 154(b) by 0 days.

(21) Appl. No.: 09/570,498

(22) Filed: May 13, 2000

Related U.S. Application Data

(60) Provisional application No. 60/133,764, filed on May 12, 1999.

(51) Int. Cl.[7] ..... G10D 13/02
(52) U.S. Cl. ..... 84/415; 84/417
(58) Field of Search ..... 84/415, 417

(56) References Cited

U.S. PATENT DOCUMENTS 4,018,130 A 4/1977 Gariepy, Sr.
4,138,920 A 2/1979 Meador
4,339,982 A * 7/1982 Hoshino ..... 84/415
4,448,105 A 5/1984 Cordes
5,275,081 A 1/1994 Freer
5,744,738 A 4/1998 Gatzen
5,844,157 A 12/1998 Kasha
6,020,547 A * 2/2000 Chen ..... 84/415
6,091,010 A * 7/2000 Gauger ..... 84/415

* cited by examiner

*Primary Examiner*—Robert E. Nappi
*Assistant Examiner*—Kim Lockett
(74) *Attorney, Agent, or Firm*—Polster, Lieder, Woodruff & Lucchesi

(57) ABSTRACT

A snare drum assembly is provided which enables the snare drum element to be positioned internally of a drum. In the preferred embodiment, the snare mechanism acts against the top drum head of a drum, and permits the drum manufacturer to eliminate the lower drum head and related structure, greatly simplifying drum construction and cost.

24 Claims, 2 Drawing Sheets

SNARE DRUM MECHANISM

CROSS REFERENCE TO RELATED APPLICATIONS

U.S. Provision Patent Application No. 60/133,764 filed May 12, 1999, from which priority is claimed.

STATEMENT REGARDING FEDERALLY SPONSORED RESEARCH OR DEVELOPMENT

BACKGROUND OF THE INVENTION

This invention relates to snare drums, and in particular, to a device for positioning snare mechanisms internally of a drum which permits adjustment of both the tension on and the position of a snare assembly with respect to a drum head through a single adjustment device positioned externally of the drum.

Snare drums are used frequently in marching bands. These drums produce a unique sound due to the snare mechanism. The snares commonly are located externally of the drum, generally being positioned on the bottom of the drum against the lower drum head. Even when the snare mechanism is positioned internally of the drum, however, the conventional construction employed for these drums has left unsolved a number of problems associated with their construction.

For younger and older musicians in a marching band, for example, the snare drum can become heavy, especially after being carried over a long parade route. The largest part of the weight comes from the top and bottom head assembly and the snare mechanism. Also, the externally mounted snare mechanisms are subject to damage and detuning. Tuning of the snares is complex and presently performed prior to use. To obtain optimum sound quality, a snare tension adjustment and a head pressure adjustment are required. None of these adjustments are easy to accomplish in normal circumstances. They become more problematical if attempted during a parade, for example.

Several inventions have sought to improve the sound quality of snare drums by using various devices for snare mechanism attachment. U.S. Pat. No. 5,844,157 to Kasha describes a method for fine-tuning of the snares such that a portion of the snares can be adjusted without affecting the remaining snares. The mechanism was attached externally to the bottom of the drum where the mechanism is subject to get damaged. Also, single adjustment screws located on the mechanism do not allow for in use adjustment. The U.S. Pat. No. 5,275,081 to Freer, describes a mechanism using individual adjusting screws to solve tuning problems. This mechanism utilizes multiple adjustment screws to provide for the fine-tuning of the snares.

Other snare drum mechanism inventions have been made to improve the sound quality of the snare drums, however, none of the prior art of which we are aware has addressed the problem of reducing the weight of a snare drum by simplifying the mechanism and/or allowing removal of some drum parts. An additional benefit of the weight reduction with our invention is a potential cost saving in total snare drum costs.

Furthermore, the prior art does not disclose a method for attaching the snare mechanism internally of the drum structure where it may act on and in conjunction with the upper drum head and/or the lower drum head. The structure of our invention permits a manufacturer to eliminate the lower portion of the drum to reduce the weight and cost of the drum itself. Additionally, even when employed with convention drum constructions, the invention disclosed hereinafter employs a novel structure which permits tension and pressure adjustments of the snare mechanism simply and easily at any time, in manner substantially simpler than possible with prior art designs.

BRIEF SUMMARY OF THE INVENTION

One important object of the present invention is to provide a simplified snare mechanism enabling a manufacturer to reduce substantially the overall weight of a snare drum.

Another object of the invention is to provide a method and structure permitting the internal attachment of snare assembly for a drum.

Yet another object of this invention is to provide an external tension adjustment on one side of a snare drum and a combined tension and height adjustment on the other side of the drum.

Another object of this invention is to provide a snare mechanism which allows simultaneous adjustment of the height and tension applied to a snare assembly.

Still another object of this invention is to provide an easy adjustment mechanism that can be operated while the drum is in use.

Another object of this invention is to provide a snare mechanism construction that allows a manufacturer the choice of installing the snare mechanism on either the top or the bottom head of a drum.

It is another object of this invention to provide a built in tone damper with a head over snare mechanism located on either the top or bottom of the drum.

In accordance with this invention, generally stated, a snare mechanism is provided for internal attachment of the snare mechanism to a drum structure. In the preferred embodiment, the drum includes a single upper drum head and the snare mechanism is adapted to operate in conjunction with the upper head. Drum construction is simplified, because the lower drum head and related structure is eliminated, resulting in significant reduction in cost and weight for the drum.

In another embodiment, the snare drum mechanism is positioned internally of the drum structure, but may be positioned to operate in conjunction of either the upper or the lower drum head. In either embodiment, the snare tensioning mechanism is designed so as to pivot into and out of a desired condition and/or position with respect to the associated drum head.

These and other objects and features of the present invention will become apparent to those skilled in the art in light of the following disclosure and accompanying drawings.

DETAILED DESCRIPTION OF INVENTION

The following detailed description illustrates the invention by way of example and not by way of limitation. This description will clearly enable one skilled in the art to make and use the invention, and describes several embodiments, adaptations, variations, alternatives and uses of the invention, including what we presently believe is the best mode of carrying out the invention. As various changes could be made in the above constructions without departing from the scope of the invention, it is intended that all matter contained in the above description or shown in the accompanying drawings shall be interpreted as illustrative and not in a limiting sense.

Figure 1:
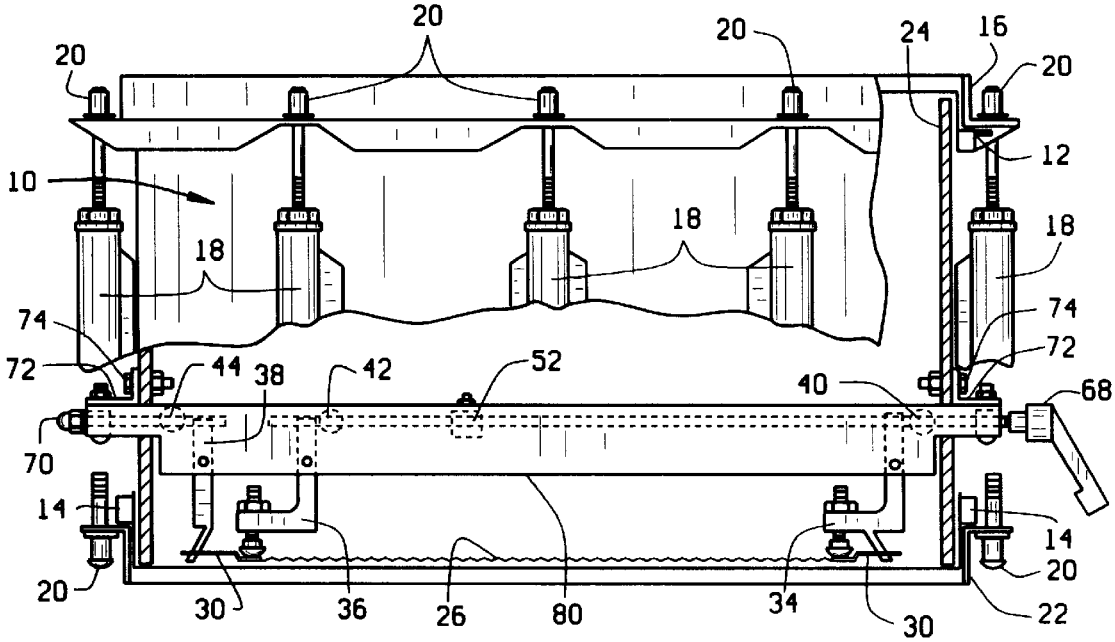
FIG. 1 is a view in side elevation, partly in sections and partly broken away of a snare drum with a bottom mounted snare mechanism assembly according to the present invention.

Referring now to FIG. 1, reference numeral 10 indicates a snare drum employing one illustrative embodiment of snare mechanism 80 of the present invention. As will be appreciated by those skilled in the art, the drum 10 is conventional, and includes a shell 24, a top hoop 16, a bottom hoop 22, a top drum head 12, and a bottom drum head 14. A set of tension rods 20 extend through and between the top drum hoop 16 and the bottom hoop 22. The tension rods 20 are held in position be a series of lugs 18. The lugs 18 are attached to the drum 10 along the top and bottom drum hoops 16 and 22 respectively, so as to apply tension on the drum heads 12 and 14 in a conventional manner.

The drum 10 also has the snare mechanism 80 associated with it. The mechanism 80 is attached to the drum shell 24, in the embodiment illustrated in FIG. 1, by attaching angles 72 which are in turn attached to the drum shell 24 by conventional threaded fasteners or screws 74. As will be appreciated by those skilled in the art, other fastener methods and/or other attachment means are compatible with the broader aspects of this invention.

The snare mechanism 80 includes a tensioning knob 70, a tensioner push nut 44, a tensioner arm 38, a lifter tensioner handle 68, a lifter tensioner push nut 40, a lifter tensioner 34, an idler block 52, a lifter push nut 42, a lifter 36 and a wire snare assembly 26, all described in greater detail below. These particular elements are associated with a snare housing or support structure 32.

As may be observed in FIG. 1, the mechanism 80 is designed to work in conjunction with the bottom drum head 14, and as shown, is positioned within the volume defined by the shell 24. This is an important feature of our invention in that the mechanism 80 may be positioned for operation in conjunction with either the top or the bottom drum head, and the internal mounting acts to protect the mechanism 80, and particularly the wire snare assembly 26 from damage.

As thus described, those skilled in the art will recognize that the snare mechanism 80 of the present invention works well with the drum head 14 embodiment shown in FIG. 1, and offers substantial advantages over prior art designs known to us. In addition, we have found, that the mechanism 80 of the present invention can be utilized to reduce the weight of a snare drum substantially.

Figure 2:
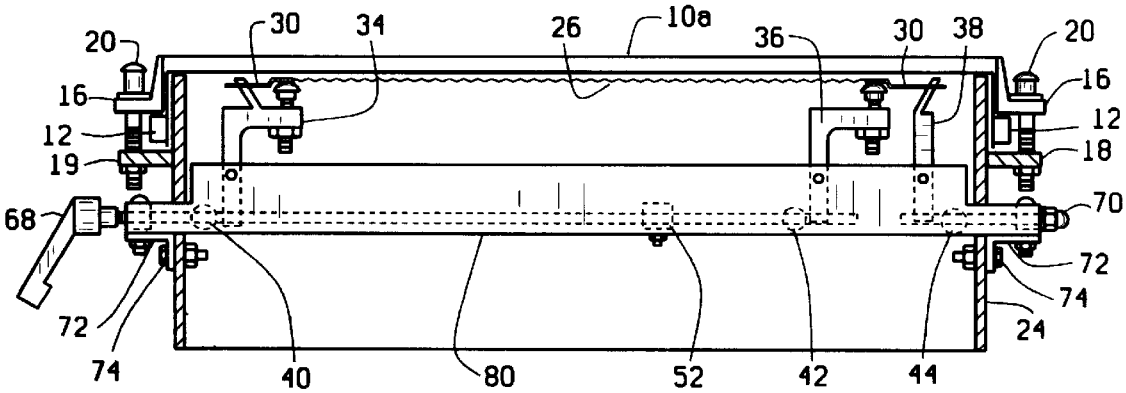
FIG. 2 is a side view, partly in. section of the preferred embodiment of the invention, shows a snare drum with a top mounted snare mechanism assembly according to the present invention.

Application of the mechanism 80 in such a reduced weight embodiment is shown in FIG. 2. As there shown, a snare drum 10*a* includes the aforementioned shell 24, the top hoop 16, and the top drum head 12. The tensioning rods 20 again pass through the top drum hoop 16, but in the embodiment of FIG. 2, engage and are fastened to the shell 24 along a rim 19. The lugs 18 and tensioning rods 20 apply tension to the top drum head 12 in a conventional manner. In the embodiment of FIG. 2, however, the snare mechanism 80 is adapted to work in conjunction with the top drum head 12, so that the entire lower portion of the snare drum 10*a* is eliminated. This is a particularly useful weight saving feature that we have found does not perceptively effect the sound performance of the drum 10*a*, and permits a manufacturer not only reduce the weight of the drum, but also to reduce the cost of the drum substantially.

Again, the mechanism 80 is attached to the drum shell 24 with attaching angles 72 and threaded fasteners 74. With each of the embodiments of FIGS. 1 and 2, the snare mechanism is mounted internally of the shell 24. As indicated above, this arrangement protects the mechanism 80 against damage during drum use.

Figure 3:
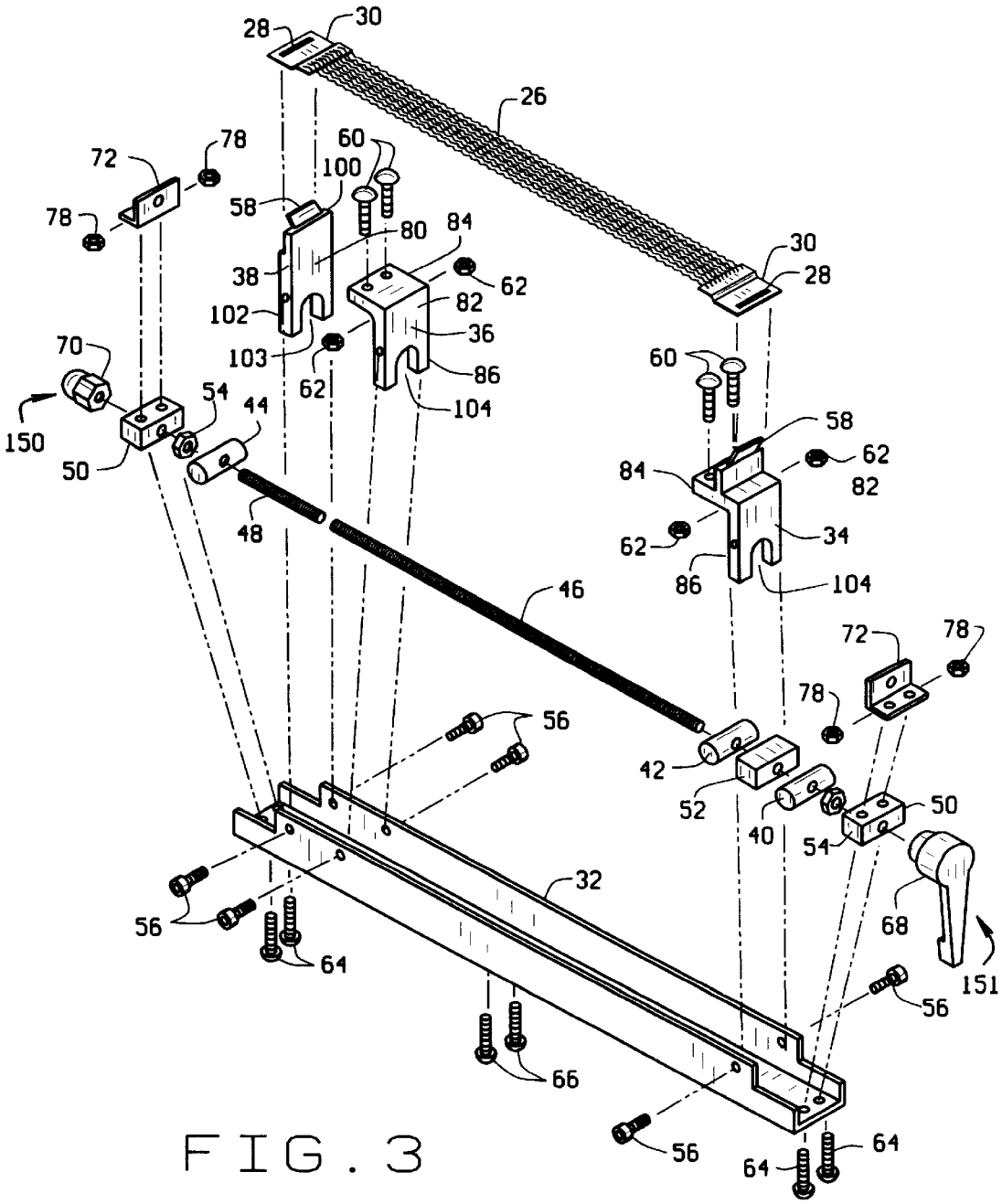
FIG. 3 is an exploded view of a snare mechanism assembly according to the present invention.

Referring now to FIG. 3, the mechanism 80 is shown in an exploded view. As there shown, the mechanism 80 has a tension end 150 and an adjustment end 151. The ends 150, 151 interact with one another to provide proper snare operation of the drum 10*a*. The tension end 150 is designed to maintain a predetermined tension on the wire snare assembly 26, while the end 151 is designed to adjust the position of the snare assembly 26 with respect to the drum head with which the mechanism 80 is operatively associated, and to provide a precision tension adjustment of the snare assembly 26 during operational use.

As shown in FIG. 3, the tensioning knob 70 is attached to a tensioner threaded rod 48. The rod 48 is threadedly engaged with and through the tensioner push nut 44 and passes through an mounting idler block 50. The rod 48 is held in position by a lock nut 54. The mounting idler block 50 servers a number of purposes. The block 50 on the end 150 of the mechanism 80 threadedly receives attaching screws 64 which pass through the snare housing 32, the mounting idler block 50 and through the angle 72, in turn permitting attachment of the mechanism 80 to the shell 24.

The tensioner 38 also is positioned on the end 150. The tensioner 38 has a body 80 having a first end 100 and a second end 102. The second end 102 has a channel 103 formed in it, which permits passage of the rod 48. The pusher nut 44 abuts the tensioner 38 along the end 102 of the tensioner. The tensioner 38 is attached to the snare housing 32 by threaded fasteners 56. The fasteners 56 permit the tensioner 38 to pivot about them and to rotate with respect to the housing 32, as later described. The second end 100 of the tensioner 38 has an angled tab 58 form in it, which extends outwardly upwardly from it, reference to FIG. 3, for purposes later described in greater detail.

The lifter 36 has a body 82 having a first end 84 and a second end 86. End 86 has a channel 104 formed in it, which permits the passage of the rod 46 in applicational use. The end 86 of the lifter 36 is attached to the snare housing 32 by a pair of the pivot screws or fasteners 56. The fasteners 56 permit the lifter 36 to pivot about them and to rotate with respect to the housing 32, as latter described. The end 84 of the lifter 36 has a pair of adjusting elements 60 mount to it, which in the embodiment illustrated are large headed threaded fasteners or screws held in position with respect to the lifter 36 by lock nuts 62.

A lifter pusher nut 42 is mounted on the rod 46 and is position to abut the end 86 of the lifter 36 during operation of the mechanism 80. As will be appreciated by those skill in the art, the components of the mechanism 80 along each of the ends 150 and 151 are similar to one another, and like part may be substituted for one another during assembly of the mechanism 80.

The idler block 52 functions to provide support for the rod 46 over the length of the housing 32. The idler block 52 is maintained in position with respect to the housing 32 by threaded fasteners 66 which pass through the housing 32 and are threadly engaged with the block 52.

As indicated above, the end 151 of the mechanism 80 has a lifter tensioner 34 associated with it. As best seen in FIG. 3, the lifter tensioner 34 is substantially similar to the lifter 36, and like reference numerals are used to indicate like components. A detailed description of the lifter tensioner 34 is not repeated for brevity's sake. However, the lifter tensioner 34 performs both a tension function and a lifting function, combining both functions in a single element. Again, the lifter tensioner 34 is attached to the snare housing 32 by pivot screws 56, permitting the lifter tensioner 34 to rotate about the screws 56 and pivot with respect to the housing 32. Adjusting screws 60 also are threaded into the lifter tensioner 34 and locked into place with adjusting screw lock nuts 62.

Wire snare assembly 26 includes a number of helical wires that are attached at each of their ends to a snare plate 30. Each snare plate 30 includes a snare assembly receptacle 28. The wire snare assembly 26 is attached to the tensioner 38 at one end, by passing the snare assembly receptacle 28 over the angle tab 58. The opposite end of the wire assembly 26 is attached to the lifter tensioner 34 by passing the snare assembly receptacle 28 over the angle tab 58 of the lifter tensioner 34.

The handle 68 is attached to the rod 46 at the end 151 of the mechanism 80. The end 151 of the rod 46 passes through the mounting idler block 50, and is threadedly engaged with the lifter tensioner pusher nut 40 and the locking nut 54. The lifter tensioner pusher nut 40 on the end 151 of the mechanism engages the end 86 of the lifter tensioner 34 during operation of the mechanism 80. The handle end of the rod 46 also passes through a second mounting idler block 50 and the rod 46 is secured to the handle 68 by any convenient method.

As with the opposite end of the mechanism 80, mounting screws 64 pass through the housing 32, are threadedly received by mounting idler block 50, and pass through the attaching angle 72, to which they are secured with threaded fasteners 78.

Snare housing 32, in the embodiment illustrated, is a channel shaped member sized to fit functionally with the particular drum with which it finds application. The width of the channel of the housing is not critical, the width being chosen to provide stability to the parts being attached to it. Other designs for the housing 32 will be apparent to those skilled in the art.

In utilizing the snare assembly 80 with the drum 10 or 10*a*, the assembly is inserted through two slots cut at opposite sides into the drum shell 24, and attached to the drum shell 24 through the attaching angles 72. Each end of the wire assembly 26 is attached to the angle tab 58 through the snare assembly receptacle 28. The end 150 of the mechanism 80 is adjusted to permit attachment of the snare assembly 26 to the respective tensioner elements. The end 150 also allows for course adjustment of the desired tension by turning the tensioner knob 70, which is connected to the tensioner threaded rod 48 passing through the end 150 mounting idler block 50. The idler block 50 is locked into place with the locking nut 54, allowing the tensioner rod 48 to spin freely in the mounting idler block 50.

The mounting idler block 50 attaching screws 64 passed through the snare housing 32 and thread into the mounting idler block 50, making it stationary. The tensioner push nut 44 is attached to the tensioner threaded rod 48, and rotation of the tensioner nut 70 causes the tensioner push nut 44 to push against the end 102 of the tensioner 38, in turn causing the tensioner 38 to pivot on or about pivot screws 56. This motion itself allows a wide range of tension adjustment on the wire snare assembly 26.

The end 151 of the wire snare assembly 26 is attached to the angle tab 58 on the lifter tensioner 34 along its respective snare assembly receptacle 28. The lifter tensioner handle 68 is connected to the lifter tensioner threaded rod 46. The rod 46 passes through the end 151 mounting idler block 50. The mounting idler block 50 is locked into position by locking nut 54, allowing the lifter tensioner threaded rod 46 to spin freely in the mounting idler block 50.

The pusher nut 40 on the end 151 is positioned to abut the end 86 of the lifter tensioner 34. When the lifter tension handle 68 is turned, the lifter tension push nut 40 and the lifter push nut 42 push against the lifter tensioner 34 and the lifter 36 at the same time. As the pusher nuts bear on the lifter tensioner 34 and lifter 36, they pivot on or about the pivot screw 56, raising the adjusting screws 60 against the snare assembly plate 30, which in turn pushes the wire snare assembly 26 against the bottom drum head 14 (FIG. 1) or the top drum head 12, (FIG. 2). As the lifter tensioner 34 pivots upwardly, it also pivots away from the tensioner 38, producing a fine tension adjustment. In addition, the adjusting screws 60, which are mounted into the lifter tensioner 34 and lifter 36, can be adjusted to insure equal points of contact for the snare assembly 26 when engaged against the bottom head 14 (FIG. 1) or the top drum head 16 (FIG. 2). After the last mentioned adjustment, the adjusting screws 60 are then locked into place with adjusting screw lock nuts 62. As will be appreciated, rotation of the handle 68 in the opposite direction causes the wire snare assembly 26 to move in a direction away from its associated the drum head.

Figure 4:
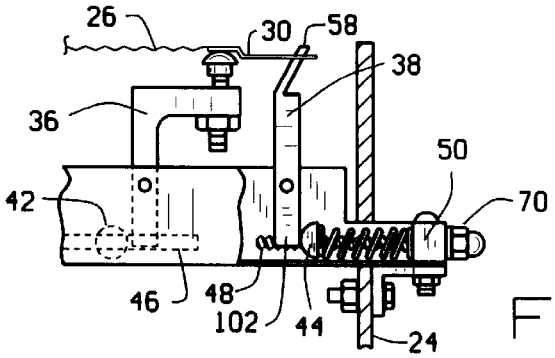
FIG. 4 is a view in side elevation, partly broken away and partly in section of an improved tensioning mechanism employed with the snare mechanism of the present invention.

An alternative embodiment for course tensioning of the snare assembly 26 is shown in FIG. 4. As there shown, the rod 48 has the push nut 44 threadedly mounted to it, and the nut 44 is positioned against the tensioner 38. A spring 110 is biased between the push nut 44 and the mounting idler block 50. The spring 110 exerts a spring force against the end 102 of the tensioner 38. The force exerted on the tensioner 38 may be adjusted through the tension nut 70, but in operational use, the tension on the tensioner 38 is maintained automatically under the force of the spring 110. That force is altered through the operation of the handle 68. As the handle 68 is rotated to lift the snare assembly 26 into operational position with its associated drum head, the end 102 of the tensioner 38 compresses the spring 110, which exerts a greater spring force on tensioner 38, thereby increasing the tension on the snare assembly 26. Rotation of the handle in the opposite direction has the opposite effect on the snare assembly 26. This action occurs automatically with a single adjustment of the handle 68.

Numerous variations, within the scope of the appended claims, will be apparent to those skilled in the art in light of the foregoing description and accompanying drawings. Merely by way of example, while conventional threaded fasteners were described as being utilized in conjunction with the various aspects of the invention, other fastening means may be employed, if desired. Likewise, the design silhouette of various components described in conjunction with the preferred embodiment may vary in other embodiments of this invention. For example, the design of the housing 32, the push nuts and the adjusting screws 60 all may vary in other embodiment of the invention, either individually or in various combinations. Other designs for attaching the mechanism 80 to the drum shell 24 may be used. Likewise, other convention drum components may be utilized with our invention. These variations are merely illustrative.

Having thus described the invention, what is claimed and desired to be secured by letters patent is:

1. The snare drum assembly wherein the other of said first and said second tensioners has a second lifter structure associated with it.

2. The snare drum assembly of claim 1 further including a first tension mechanism associated with said first tensioner, said first tensioner mechanism permitting a user to make a second tension adjustment on said snare element.

3. The snare drum assembly of claim 2 further including a first rod rotatably mounted to said support structure, rotation of first said rod applying a force on said first tensioner.

4. The snare drum assembly of claim 3 further including a second rod rotatably mounted to said support structure, each of said first and said second rods having at least one pusher nut mounted to it, and a plurality of pusher nuts, at least one said pusher nut plurality being mounted to each of said first and said second rods.

5. The snare drum assembly of claim 3 wherein said lifter mechanisms are adjustable.

6. The snare drum assembly of claim 5 further including a drum structure, said drum structure having a shell and a top drum head, said snare drum assembly being attached to said shell and positioned thereon in operative arrangement with said top drum head.

7. The snare drum assembly of claim 6 wherein said drum structure has a top covered by said top drum head and an open bottom.

8. The snare drum assembly of claim 5 further including a drum structure, said drum structure having a shell, a top drum head and a bottom drum head, said snare assembly being attached to said shell and positioned thereon in operative arrangement with one of said top and said bottom drum heads.

9. The drum assembly of claim 2 wherein said first tensioner includes a second rod rotatably mounted with respect to said support element, a pusher nut mounted on said second rod, and a spring biased to exert a force on said first tensioner.

10. A snare drum comprising:

a shell defining an internal volume;

a top drum head;

a snare assembly, said snare assembly being positioned within said internal volume in a location which protects the snare assembly from inadvertent contact; and at least one adjustment structure accessible externally of said shell for adjusting the snare element internally of said shell, said adjustment structure acting on said snare assembly so as to move said snare assembly simultaneously in two planes.

11. The snare drum of claim 10 wherein said snare assembly comprises:

a snare element;

a support structure;

a first tensioner attached between said support structure and said snare element; and a second tensioner attached between said support element and said snare element, said first and said second tensioners being mounted for rotation about said support structure.

12. The snare drum of claim 11 further including a first lifter, said first lifter being positioned near one of said first and said second tensioners, said first lifter being rotatably mounted to said support structure and extending between said support structure and said snare element.

13. The snare drum of claim 12 wherein the other of said first and said second tensioners has a lifter structure integrally formed with it.

14. The snare drum of claim 13 further including a first tension mechanism associated with said first tensioner, said first tension mechanism permitting a user to make a first tension adjustment for said snare element.

15. The snare drum of claim 14 wherein said lifter mechanisms are adjustable.

16. The snare drum of claim 15 further including a first rod rotatably mounted to said support structure, said first rod having a pusher nut associated with said first rod, said pusher nut operatively abutting said first tensioner so as to exert a predetermined force thereon.

17. The snare drum of claim 16 further including a second rod rotatably mounted with respect to said support structure, said second rod having a second pusher nut and a third pusher nut operatively associated with it, one of said first and said second pusher nuts being positioned on said second rod so as to exert a force on said second tensioner.

18. The snare drum of claim 17 further including a second lifter, and a third pusher nut operatively associated with said rod so as to exert a force on said second lifter.

19. The snare drum assembly of claim 18, further including a first tension adjustment operatively connected to said first tensioner; and a second tension adjustment operatively connected to said second tensioner.

20. The snare drum assembly of claim 19 wherein said first tensioner adjustment includes a spring biased to exert a tension force on said snare element.

21. A snare drum, comprising:

a shell;

at least one drum head;

a snare assembly operatively associated with said drum head, said snare assembly including a snare element, at least one adjustment structure, said adjustment structure including tension and lifting devices acting on said snare element so as to lift and tension said snare element simultaneously, and a second adjustment device is adjusted to provide equal points of contact for the snare assembly along the drum head.

22. A snare drum assembly comprising:

a snare element;

a support structure;

a first tensioner attached between said support structure and said snare element;

a second tensioner attached between said support structure and said snare element, each of said first and said second tensioners being pivotally mounted to said support structure so that one direction of rotational movement of said tensioners about said support structure both moves said snare element in a first direction and exerts a first tension force on the snare element; and a first lifter, said first lifter being positioned near one of said first and said second tensioners, said first lifter being pivotally mounted to said support structure and extending between said support structure and said snare element.

23. A snare drum assembly including:

a drum structure, said drum structure including a shell and a top drum head, comprising;

a snare element, said snare element being positioned to operate in conjunction with said top drum head, said drum assembly have an open bottom; a snare drum element;

a support structure;

a first tensioner attached between said support structure and said snare element;

a second tensioner attached between said support structure and said snare element, each of said first and said second tension elements being rotationally mounted with respect to said support structure, at least one of said first and said second tensioners acting simultaneously to move said snare element both horizontally and vertically; and a first tension adjustment operably connected to said first tensioner;

a second tension adjustment operably connected to said second tensioner, wherein said first and said second tension adjustments are accessible externally of the shell.

24. A snare drum assembly comprising:

a snare element;

a support structure;

first means for tensioning the snare element attached to said support structure;

second means for tensioning the snare element attached to aid support structure; and means for adjusting said first and second tensioning means simultaneously by and through a single movement of said adjusting means.

* * * * *

UNITED STATES PATENT AND TRADEMARK OFFICE

CERTIFICATE OF CORRECTION

PATENT NO. : 6,441,287 B1 
DATED : August 27, 2002
INVENTOR(S) : Steve P. Crouch, Mark W. Schafer and Roy A. Murray It is certified that error appears in the above-identified patent and that said Letters Patent is hereby corrected as shown below:

Column 7,
Line 3, please delete all claims and substitute the following claims in it's place:

1. A snare drum assembly comprising:

a snare element;

a support structure;

a first tensioner attached between said support structure and said snare element;

a second tensioner attached between said support structure and said snare element, each of said first and said second tensioners being pivotally mounted to said support structure so that one direction of rotational movement of said tensioners about said support structure both moves said snare element in a first direction and exerts a first tension force on the snare element; and a first lifter, said first lifter being positioned near one of said first and said second tensioners, said first lifter being pivotally mounted to said support structure and extending between said support structure and said snare element.

---

2. The snare drum assembly of Claim 1 wherein the other of said first and said second tensioners has a second lifter structure associated with it.

3. The snare drum assembly of Claim 2 further including a first tension mechanism associated with said first tensioner, said first tensioner mechanism permitting a user to make a second tension adjustment on said snare element.

4. The snare drum assembly of Claim 3 further including a first rod rotatably mounted to said support structure, rotation of first said rod applying a force on said first tensioner.

5. The snare drum assembly of claim 4 further including a second rod rotatably mounted to said support structure, each of said first and said second rods having at least one pusher nut mounted to it, and a plurality of pusher nuts, at least one said pusher nut plurality being mounted to each of said first and said second rods.

6. The snare drum assembly of Claim 4 wherein said lifter mechanisms are adjustable.

7. The snare drum assembly of Claim 6 further including a drum structure, said drum structure having a shell and a top drum head, said snare drum assembly being attached to said shell and positioned thereon in operative arrangement with said top drum head.

---

It is certified that error appears in the above-identified patent and that said Letters Patent is hereby corrected as shown below:

Column 7 (cont'd),

8. The snare drum assembly of Claim 7 wherein said drum structure has a top covered by said top drum head and an open bottom.

9. The snare drum assembly of Claim 6 further including a drum structure, said drum structure having a shell, a top drum head and a bottom drum head, said snare assembly being attached to said shell and positioned thereon in operative arrangement with one of said top and said bottom drum heads.

10. The drum assembly of Claim 3 wherein said first tensioner includes a second rod rotatably mounted with respect to said support element, a pusher nut mounted on said second rod, and a spring biased to exert a force on said first tensioner.

11. A snare drum comprising:

a shell defining an internal volume;

a top drum head;

a snare assembly, said snare assembly being positioned within said internal volume in a location which protects the snare assembly from inadvertent contact; and at least one adjustment structure accessible externally of said shell for adjusting the snare element internally of said shell, said adjustment structure acting on said snare assembly so as to move said snare assembly simultaneously in two planes.

12. The snare drum of Claim 11 wherein said snare assembly comprises:

a snare element;

a support structure;

a first tensioner attached between said support structure and said snare element; and a second tensioner attached between said support element and said snare element, said first and said second tensioners being mounted for rotation about said support structure.

13. The snare drum of Claim 12 further including a first lifter, said first lifter being positioned near one of said first and said second tensioners, said first lifter being rotatably mounted to said support structure and extending between said support structure and said snare element.

14. The snare drum of Claim 13 wherein the other of said first and said second tensioners has a lifter structure integrally formed with it.

15. The snare drum of Claim 14 further including a first tension mechanism associated with said first tensioner, said first tension mechanism permitting a user to make a first tension adjustment for said snare element.

16. The snare drum of Claim 15 wherein said lifter mechanisms are adjustable.

It is certified that error appears in the above-identified patent and that said Letters Patent is hereby corrected as shown below:

Column 7 (cont'd),

17. The snare drum of Claim 16 further including a first rod rotatably mounted to said support structure, said first rod having a pusher nut associated with said first rod, said pusher nut operatively abutting said first tensioner so as to exert a predetermined force thereon.

18. The snare drum of Claim 17 further including a second rod rotatably mounted with respect to said support structure, said second rod having a second pusher nut and a third pusher nut operatively associated with it, one of said first and said second pusher nuts being positioned on said second rod so as to exert a force on said second tensioner.

19. The snare drum of Claim 18 further including a second lifter, and a third pusher nut operatively associated with said second rod so as to exert a force on said second lifter.

20. The snare drum assembly of claim 23, further including a first tension adjustment operatively connected to said first tensioner; and a second tension adjustment operatively connected to said second tensioner.

21. The snare drum assembly of Claim 20 wherein said first tensioner adjustment includes a spring biased to exert a tension force on said snare element.

22. A snare drum, comprising:

a shell;

at least one drum head;

a snare assembly operatively associated with said drum head, said snare assembly including a snare element, at least one adjustment structure, said adjustment structure including tension and lifting devices acting on said snare element so as to lift and tension said snare element simultaneously, and a second adjustment device is adjusted to provide equal points of contact for the snare assembly along the drum head.

23. A snare drum assembly including:

a drum structure, said drum structure including a shell and a top drum head, comprising;

a snare element, said snare element being positioned to operate in conjunction with said top drum head, said drum assembly have an open bottom; a snare drum element;

a support structure;

a first tensioner attached between said support structure and said snare element;

a second tensioner attached between said support structure and said snare element, each of said first and said second tension elements being rotationally mounted with respect to said support structure, at least one of said first and said second tensioners acting simultaneously to move said snare element both horizontally and vertically; and

UNITED STATES PATENT AND TRADEMARK OFFICE

CERTIFICATE OF CORRECTION

PATENT NO. : 6,441,287 B1 
DATED : August 27, 2002
INVENTOR(S) : Steve P. Crouch, Mark W. Schafer and Roy A. Murray It is certified that error appears in the above-identified patent and that said Letters Patent is hereby corrected as shown below:

Column 7 (cont'd), a first tension adjustment operably connected to said first tensioner;

a second tension adjustment operably connected to said second tensioner, wherein said first and said second tension adjustments are accessible externally of the shell.

---

24. A snare drum assembly comprising:

a snare element;

a support structure;

first means for tensioning the snare element attached to said support structure;

second means for tensioning the snare element attached to aid support structure; and means for adjusting said first and second tensioning means simultaneously by and through a single movement of said adjusting means.

---

Signed and Sealed this

Fourth Day of May, 2004

JON W. DUDAS
*Acting Director of the United States Patent and Trademark Office*